United States Patent [19]

Marchiori et al.

[11] Patent Number: 4,779,409

[45] Date of Patent: Oct. 25, 1988

[54] METHOD AND SYSTEM FOR SPINNING WITH A ROTARY BALLOON-CHECKING DEVICE

[75] Inventors: Mirko Marchiori, Pordenone; Carlo Sonego, San Fior; Fabio Lancerotto, Milan; Umberto Gerin, Pordenone, all of Italy

[73] Assignee: Cerit S.p.A., Pordenone, Italy

[21] Appl. No.: 940,538

[22] Filed: Dec. 10, 1986

[30] Foreign Application Priority Data

Dec. 10, 1985 [IT] Italy ..... 83441 A/85

[51] Int. Cl.[4] ..... D01H 7/18; D01H 7/66; D01H 13/04

[52] U.S. Cl. ..... 57/354; 57/67; 57/74; 57/352

[58] Field of Search ..... 57/67–72, 57/74, 354–357, 352, 124

[56] References Cited

U.S. PATENT DOCUMENTS

| | | | |
|---|---|---|---|
| 1,969,685 | 8/1934 | Bird | 57/74 |
| 2,689,449 | 9/1954 | Clarkson | 57/356 |
| 3,122,876 | 3/1964 | Matsui | 57/124 |
| 3,593,510 | 7/1971 | Taylor | 57/74 |
| 3,638,415 | 2/1972 | Andrews | 57/355 |
| 3,785,140 | 1/1974 | Muller | 57/124 X |
| 3,851,448 | 12/1974 | Sano et al. | 57/124 X |
| 4,437,300 | 3/1984 | Vignon | 57/74 |
| 4,592,196 | 6/1986 | Wolf | 57/74 |

FOREIGN PATENT DOCUMENTS

| | | | |
|---|---|---|---|
| 544551 | 6/1956 | Italy | 57/124 |

*Primary Examiner*—John Petrakes
*Attorney, Agent, or Firm*—Wegner & Bretschneider

[57] ABSTRACT

An invention for spinning with a balloon controlled by a checking device is disclosed. The invention is set in rotation by a spindle by means of a yarn, comprising the arrangement of a segment of free yarn constituting a balloon having a controlled and constant height and diameter of base and also comprising the arrangement of a guided segment of yarn downstream of the segment constituting the balloon. Also, the invention is for spinning with a rotary balloon-checking device, comprising a rotary checking device positioned about a yarn package and a tube and having a rotatably supported upper portion and a lower portion performing the function of distributing the yarn on the yarn package, wherein the checking device is open at its upper end and has a predetermined diameter to contact the yarn.

20 Claims, 5 Drawing Sheets

METHOD AND SYSTEM FOR SPINNING WITH A ROTARY BALLOON-CHECKING DEVICE

Figure 2A:
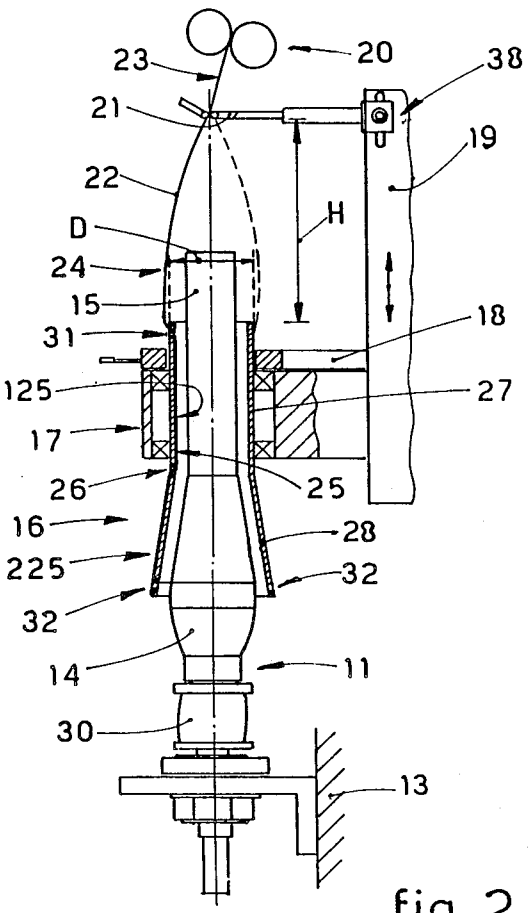

This invention concerns a method for spinning with a controlled balloon and also a system for spinning with a rotary balloon-checking device which carries out the method.

The spinning system of the invention is suitable to spin and twist fibres of any material, whether of a staple length for wool or a staple length for cotton;

The invention is especially advantageous for yarns of a medium-fine and fine count and for yarns of materials which are mechanically less resistant or are more sensitive to the heating action of the ring in traditional systems.

In general, the invention is especially advantageous in all cases where the yarn is very subject to breakage, such as, for instance, in spinning pure wool, or is very subject to damage caused by heat, as in the spinning of manmade fibres, for example.

The known art includes many systems for spinning fibres with insertion of a real twist, such as a ring spinning system, for instance.

Good spinning of such a type should obtain a qualitatively sound yarn at a satisfactory speed of output and with yarn packages of a good weight suitably packaged for the subsequent processes.

To obtain this purpose the spinning system should make possible the following:

the selection of the optimum value of tension during spinning, namely the tension on the thread leaving the drafting unit until it has been strengthened by the twisting; this means in practice the ability to predetermine a value of tension which is limited and as uniform as possible throughout the whole formation of the yarn package;

the adaptation of such tension to the requirements proper to the winding, independently of the preselected spinning tension, so as to form a yarn package of an optimum density; in practice a higher tension is required on the yarn at the moment it is wound on the yarn package, which otherwise would be too soft;

the ability to keep optimum spinning and winding tensions even at high speeds and with yarn packages of good sizes.

As regards the above the various known spinning systems with the insertion of a real twist entail various limits.

Ring spinning machines involve the drawback of giving rise to a balloon of large dimensions which depend on the diameter and height of the yarn package.

The outcome is a high tension on the yarn in the spinning zone, such tension being strictly linked to the speed of rotation of the spindle.

Moreover, such tension is not uniform since it is affected by the disturbances undergone by the traveller moving on the ring; such disturbances cause in the yarn very high frequency vibrations which increase considerably the likelihood of breakages, especially in the case of weak, fine yarns.

In such systems the balloon is checked with stationary rings on which the rotating yarn slides, thus leading to a possibility of damage to the yarn and an arresting action on the re-ascent of the twist towards the drafting unit.

Other elements being equal, the tension on the yarn in correspondence with a spinning balloon depends on the maximum radial dimension of the balloon.

The restriction of a large balloon, independently of the restriction means, does not reduce the tension on the yarn but does form an obstacle to the re-ascent of the twist.

Moreover, the traveller has a well determined limit of speed beyond which it burns; in any event it always tends to heat up and therefore to damage yarns consisting of materials sensitive to heat, such as yarns of manmade fibres, for instance.

In such a system the winding tension is strictly linked to the spinning tension since the whole system is in a dynamic equilibrium tied to the pre-selected working conditions. Such system therefore entails obvious speed limits which can only be raised by sacrificing the dimensions of the yarn package.

In classic bell-type spinning machines, whether the bell be stationary or rotary, the balloon always possesses large dimensions linked to the dimensions of the package, whether that package be a bobbin or a cop of yarn.

In this case the balloon is controlled by making the yarn slide on the lower edge or outer surface of the bell.

To maintain contact with the yarn, the bell tends to enlarge the balloon, with a consequent high spinning tension.

The bells in such cases possess considerable dimensions, which are such as to contain at first the whole tube or support of the yarn package. In view of their weight the bells are generally stationary or are set in rotation mechanically.

Since the rotations of the yarn and bell are not synchronized in such systems, there is always sliding due to rotation as a consequence.

The winding tension on the package is always tied to the spinning tension and depends on the working conditions applied.

In other spinning systems providing for rigid rotary elements such as bells or the like, the yarn is guided along its whole path by the thread guide until it is wound on the yarn package.

Such known systems entail complete elimination of the balloon, and therefore there is no exploitation of the ability of the balloon to cushion, by means of its capability of being deformed, the instantaneous and/or periodical fluctuations in tensions which take place in the yarn as its winding diameter varies or as a result of unavoidable disturbances during working.

Such an embodiment is described, for instance, in patent DE-A1-3.400.327 in the name of Zinser. In this patent the rotary bell has of necessity to contain the whole tube at the start and also is supported as a cantilever so as to enable the yarn to be wound in coils on the outer surface of the bell itself. As a result, the bell has a considerable lengthwise extent and therefore a considerable mass.

This feature entails a great inertia in respect of rotation of the bell, and this inertia has an unfavourable effect on the start-up and stopping steps and on the ability of the system to adapt itself to the periodical and instantaneous changes in speed which occur during formation of a yarn package.

Moreover, the number of coils formed by the yarn on the surface of the device, such number being self-regulated according to the working conditions, is smallest at the time when the winding is taking place on the smallest diameter, that is, on the tube. When winding is taking place on the tube, this time coincides with the maximum value of tension on the yarn being wound, precisely when the segment of yarn wound in coils is at its minimum length and therefore possesses a minimum ability to cushion the tensions.

The result is a high value of instantaneous corresponding tension, which travels back along the yarn to the drafting unit.

The known art provides also for such balloon-checking devices to be powered, and an example of this is given in the cited DE-A1-3.400.327, the purpose being to surpass the limits of sliding capacity and inertia proper to idling devices which are drawn by the yarn, espeically in the case of fine yarns.

Such systems still do not provide the possibility of programming separately the spinning tension and winding tension.

In conclusion, in the present state of the art no spinning system is known which offers all the requirements for optimum spinning as said above at one and the same time.

The purpose of this invention is to overcome the drawbacks and shortcomings of the known art by providing a new spinning method which can be applied to every type and count of yarn and which enables the spinning performance to be improved as regards the development of the spinning and an increase in speed.

The new system is different in that it does not eliminate the balloon but reduces its radial dimension by means of a rigid checking device to a value smaller than that of the diameter of the yarn package, the rigid checking device rotating in synchronization with the yarn about the yarn package. Such checking device acts also as a means to wind the yarn on the yarn package by means of its lower portion shaped as a truncated cone.

The new spinning system enables a yarn package of normal dimensions to be obtained with the formation of a balloon having a reduced diameter and height, the balloon being checked and controlled at least partially by a rigid, rotary checking device that rotates in synchronization with the yarn about the yarn package being formed.

Downstream of the zone of the balloon, which stretches between the thread eye and the upper end of the rotary balloon-checking device, this device acts as a guide for the yarn and as a means to wind the yarn on the yarn package.

There will therefore be a first segment of yarn between the drafting unit and the thread eye as in the known art, a second segment of yarn of a desired length which constitutes a balloon of limited dimensions controlled as regards its geometric parameters (height and diameter at its base), a further segment in which the yarn is guided and controlled in a desired manner until it leaves the device, and a free terminal segment which is wound onto the yarn package and transmits from the spindle to the checking device of the invention the force to set such device in rotation.

In this new system, starting with the winding tension, it is possible to pre-arrange the reduction of such tension to a desired reduced value on the basis of the balloon coinciding with the spinning tension; this can be obtained by selecting a suitable winding arc on the outer surface of the lower truncated-cone portion of the rotary checking device.

In a preferred embodiment the rotary balloon-checking device of the invention consists of a hollow cylinder with a truncated-cone base which is set in rotation by the spindle by means of the yarn. Such cylinder therefore performs at one and the same time the functions of an element to retard the winding of the yarn on the yarn package and of a rotary balloon-checking device.

The device is supported by a rail and is free to rotate; it also winds the conical portion of the yarn package being formed and part of the tube but leaves the top of the latter free.

For a given height of the yarn package, therefore, the device has an extent considerably reduced in a lengthwise direction.

The device therefore has a limited mass and inertia.

The yarn coming from the drafting unit of the spinning machine passes through the thread eye in a conventional manner and then forms a free segment in which the controlled balloon is formed during working; next, the yarn enters the top of the device in correspondence with a pre-determined diameter.

In the new system, so far as possible the checking device does not keep close to the tube and to the yarn package being formed, thus minimizing the aerodynamic resistance of the system, but the diameter of the upper portion of the checking device is selected in such a way that the balloon will possess a dimension such as to ensure a desired value of tension in the spinning and to prevent sliding of the yarn on the edge of the tube during start-up.

This diameter corresponds to the diameter of the base of the balloon and is established to suit the type of yarn so as to ensure for the balloon the condition of stability needed for good spinning together with a limited value of tension.

The yarn then is guided into the cylindrical portion of the checking device and may be simply guided onto its surface or be guided by a small pipe or conduit.

The yarn thus emerges onto the outer surface of the device below the support zone of the device itself or directly at the lower edge of the device and is wound onto the yarn package being formed. The yarn may possibly slide for a certain distance on the outer surface of the truncated-cone base and on the edge of the rotary balloon-checking device. The conical portion of the device acts as a distributor for the yarn.

The yarn may be left wholly free to move along the edge of the distributor portion, or its freedom may be restricted to a partial arc or be limited to a definite point, depending on the specific result required.

For a given base diameter of the balloon there is a limit of height for the same; with a height greater than this limit the balloon collapses.

The nearer this limit of height is approached, the more enlarged radially is the configuration of the balloon with an increased tension on the yarn, the configuration becoming less and less able to keep its stability against momentary spinning disturbances.

It follows that in most cases a tube used to form a yarn package cannot be limited in height to the inside of a free balloon having a small base dimension.

The new spinning system limits with its upper portion the balloon in the radial direction and at the same time lengthens it lengthwise.

An advantage of the new system is its simultaneous performance of three actions:

radial reduction of the base of the balloon, limitation of the height of the balloon, and the ability to pre-determine the spinning tension by choosing a given arc of winding on the surface of the lower truncated-cone portion independently of the radial reduction of the balloon.

We list below further advantages of the invention:

the invention enables the speed of output to be increased and, at the same time, the spinning conditions to be improved, the balloon is limited and, as a result, so also is the level of tension in the yarn leaving the drafting unit; this is due to the fact that the rotary checking device has radial dimensions which are smaller than the diameter of the yarn package, it is possible to regulate the winding tension by means of a brake in a known manner and to pre-set the reduction of that tension to an optimum reduced value in the spinning zone, where the yarn is still being strengthened by being twisted; this is brought about by selecting the length of the portion of the device on which the yarn is to slide, such portion for the sliding of the yarn according to the invention can be pre-set wholly or partially; for such partial pre-setting a limited and pre-set field of freedom of the yarn can be provided along the edge of the device, the geometric dimensions, that is, the base and height of the balloon, are selected so as to provide an optimum tension in the spinning conditions for the whole envisaged range of yarns; in fact, with a constant geometry of the balloon the spinning tension will vary automatically as the count varies, and will be lower for fine yarns and progressively greater for the thicker yarns; such self-regulation is well suited to the spinning requirements, the tension is more uniform, especially as regards oscillations for a short period, in view of the cushioning capability of the balloon and the lack of a traveller, the control of the spinning tension performed by means of the invention in the segment between the point where the yarn begins receiving a twist and the point where the yarn, still being consolidated, leaves the drafting unit, ensures an even and modest value of tension; as a result, the spinning is excellent, the reduced tension means also an easier re-ascent of the twist since the yarn-guide loop constitutes a lesser obstacle as an outcome of the lesser thrust of the yarn on the walls of the loop, there is a pre-determined or only partially free winding of the yarn on the truncated-cone distributor portion of the device; this obviates the presence of several coils at the moment of least tension and vice versa at the time of variation in the winding diameter; such variation of coils in the known art entails an accentuation of the variation in tension experienced when the winding diameter varies, the spinning system entails a fixed path for the yarn from the drafting unit to the yarn package if the rail bearing the checking device is stationary; if such rail can move and the rail bearing the spindles is stationary, the fixed path will run from the thread eye to the yarn package; as a result, in both cases the whole formation of the yarn package will take place with a constant balloon, the dimensions, weight and inertia of the rotary balloonchecking device of the invention are smaller than the corresponding parameters of known bell systems if the dimensions of the yarn package are the same in both cases, and therefore acceleration is facilitated during start-up and the system follows more easily the variations in revolutions of the distributor portion of the device in winding the variable diameter of the yarn package, thus preventing the occurrence of high points of tension, in view of the limited diameter of the cylindrical portion of the device, the device itself is supported at diameters smaller than that of the yarn package and therefore in advantageous conditions for reaching a great sliding capability, which is essential for the spinning of fine yarns in particular, the system does not contain points where the yarn will become hot, and damage will therefore be obviated, especially with manmade fibres.

The invention is therefore obtained with a method for spinning with a balloon controlled by a rotary checking device, in which method the yarn comprises a first free segment between a drafting unit and a thread eye and a terminal free segment between the checking device and a yarn package, the checking device being set in rotation by a spindle by means of the yarn, the method being characterized in that it comprises:

the arrangement of a segment of free yarn constituting a balloon having a controlled and constant height and diameter of base downstream of such first free segment of yarn, and the arrangement of a guided segment of yarn downstream of the segment constituting the balloon and upstream of the terminal free segment of yarn.

The invention is also embodied with a system for spinning with a rotary balloon-checking device, the system comprising a rotary balloon-checking device positioned about a package of yarn and a tube and having a rotatably supported upper portion and a lower portion performing the function of distributing the yarn on the yarn package, the system being characterized in that the checking device is open at its upper end and has a pre-determined diameter to contact the yarn.

Figure 1:
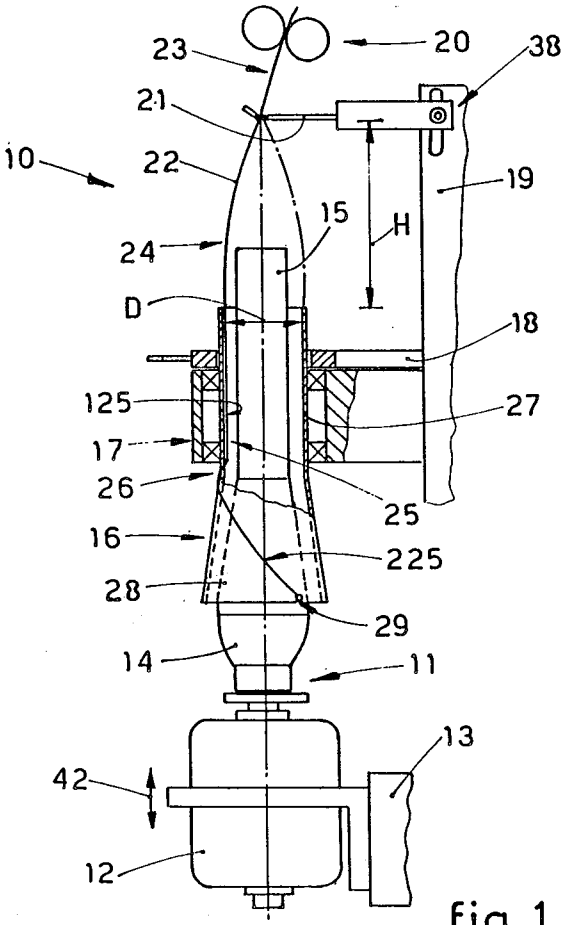
Figure 9A:
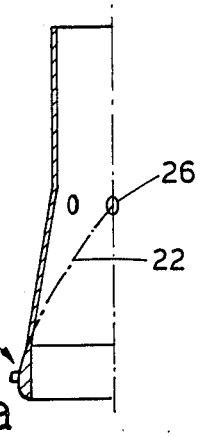
Figure 9B:
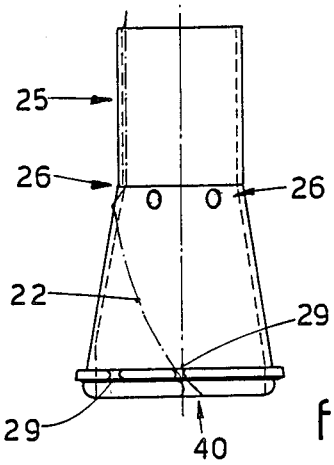

We shall now describe, as a non-restrictive example, a set of preferred embodiments of the invention with the help of the attached figures, in which:

FIG. 1 shows an embodiment of the invention;

FIG. 2*a* through 2*d* show variants of the embodiment of FIG. 1;

FIGS. 3 through 6*b* show possible variants of the checking device of the invention;

FIG. 7*a* through 7*f* show the various steps in the formation of a yarn package with a constant balloon;

FIGS. 8*a* through 8e give a diagrammatic comparison of a traditional balloon and the balloon of the invention;

FIGS. 9*a* and 9*b* show further variants.

In the figures the same parts or parts having the same functions bear the same reference numbers.

In FIG. 1 a spinning system 10 is applied to a spindle 11, which in this case is driven by an independent motor 12 fitted to a rail 13, which is moved with a reciprocating vertical motion 42 shown by an arrow, so as to form a package of yarn according to known methods. A yarn package 14 is shown during its formation on a tube 15.

A balloon-checking device 16, which consists of an upper cylindrical portion 27 and a lower truncated-cone or distributor portion 28, surrounds the yarn package being formed and lets the top of the tube 15 protrude upwards.

The cylindrical portion 27 is upheld by a support 17 with a bearing, the support being integrally fixed to a rail 19 of a spinning machine, such rail being stationary in this example.

A brake 18, of a magnetic type for instance, serves to graduate the winding tension in a known manner.

A yarn 22 coming from a drafting unit 20 forms a first segment 23 reaching a thread eye 21; a second segment of yarn 24 between the thread eye 21 and the top of the balloon-checking device 16 forms a balloon, as can be seen in FIG. 1.

This balloon has a controlled geometry since the values of the diameter of its base D (corresponding here to the inner diameter of the cylindrical portion 27) and of its height H (corresponding to the distance between the thread eye and the top of the checking device 16) are pre-set.

The height H will preferably be adjustable, for instance, by changing the height of the thread eye 21 with an adjustment means 38. The diameter D will be chosen beforehand to suit the spinning conditions and the range of yarns to be spun.

As can be seen in FIG. 1, the diameter D will be smaller than the diameter of the yarn package 14.

After the yarn has entered the checking device, it forms a segment 25 which is controlled until it is wound on the yarn package 14.

In the embodiment shown in FIG. 1 this segment 25 comprises a first portion 125 inside the checking device 16; it then emerges from the device 16 through an outlet hole 26, passes along the surface of the distributor portion 28 and then enters a lead-in 29 which determines the length of yarn between the outlet hole 26 and the lower edge of the distributor portion 28. The yarn is then wound onto the yarn package 14.

The lead-in 29 causes the yarn 22 to be engaged automatically at start-up; in this way the length of the portion 225 of yarn between the outlet hole 26 and the lead-in 29 remains constant.

FIGS. 2*a* through 2*d* show variants of the invention as applied to a spindle 11 which in this case is driven by a pulley 30 coooperating in a known manner with a belt, which is not shown. The spindle 11 is fitted to a rail 13 which is stationary in this example.

Instead, the checking device 16 is fitted by means of the support 17 to a rail 19 which here is able to move to form the yarn package 14, as is shown by arrows in the figures. This method of movement is also known.

It should be noted that in this way the length of the segment 23 of yarn between the drafting unit 20 and the thread eye 21 is varied, whereas the lengths of the segments 24 and 25 of yarn are not varied. Thus, the geometry of the balloon remains constant in this case too since the rail 19 supports the thread eye 21 too, as is shown in FIG. 2*a*.

It is possible to arrange also for an embodiment in which both the rails 13–19 are able to move. For instance, a reciprocating drawing motion will be imparted to the rail 19, whereas a motion of one-directional lowering will be imparted to the rail 13 at short intervals, as is known in the prior art.

To doff yarn packages and don empty tubes, it will be possible to carry out a relative movement as between the rails 13 and 19, for instance by lowering the rail 13 fully and rotating or traversing it so as to assist the doffing of a yarn package or the donning of a tube, or by performing another like movement.

Moreover, the rail 19 supporting the checking device 16 may be capable of being displaced transversely to a position out of alignment with the spindles.

In the embodiment of FIG. 2*a* the segment 24 of yarn forming the balloon ends at an inlet hole 31. In this case the diameter D of the base of the balloon coincides substantially, therefore, with the outer diameter of the cylindrical portion 27 of the checking device since it is geometrically determined.

The yarn 22 enters the checking device 16 through the inlet hole 31 and forms the first guided portion 125 of the segment 25 of yarn.

The yarn 22 then emerges from the outlet hole 26, slides on the surface of the distributor portion 28 of the checking device (portion 225 of yarn) and enters a winding hole 32.

FIG. 2*a* shows two winding holes 32 diametrically opposite to each other, but it is to be understood that there can be a plurality of winding holes 32 (or of lead-ins in FIG. 1) at separate positions so as to vary the length of the portion 225 of yarn as required. Likewise, there may be a plurality of outlet 26 and inlet 31 holes.

In this way it is possible to alter the percentage of tension discharged by friction between the yarn 22 and the checking device 16.

It should be noted that in the embodiment of FIG. 2*a* the yarn forms two elbows at the inlet and outlet holes 31–26, and a part of the tension will therefore be discharged at those elbows.

Figure 2D:
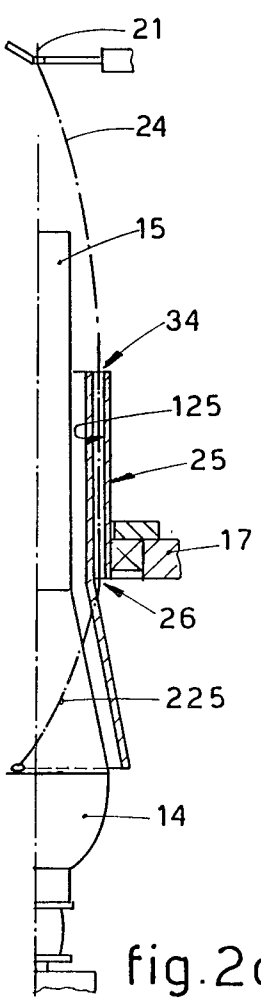
Figure 2C:
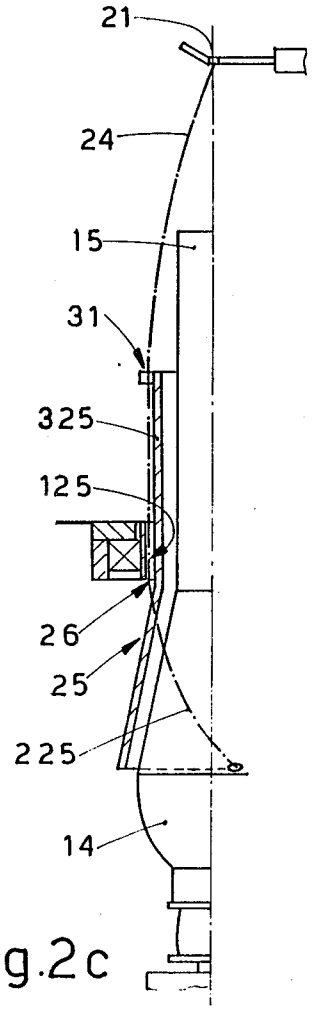
Figure 2B:
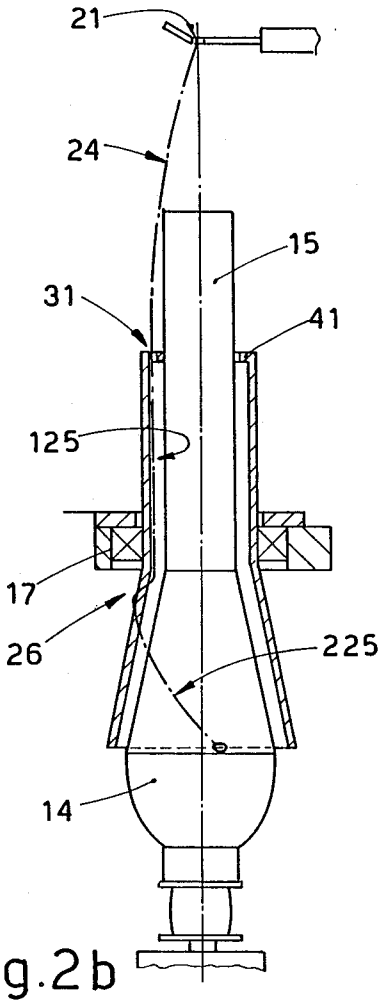

FIG. 2*b* shows a variant in which the inlet hole 31 for the yarn to enter the device is machined in a ring 41 within the cylindrical portion of the device and at the upper edge of the device. In this embodiment the yarn enters the device at a tangent to the inner wall, as in the embodiment of FIG. 1, but in this case the yarn is kept distant from the tube at start-up during the transient stage of start-up when the balloon still does not exist.

FIG. 2*c* contains a variant in which the yarn is guided, outside the upper portion of the device, along the segment 325 of yarn between the inlet hole 31 and outlet hole 26. In this case the segment 125 of yarn within the device develops along the whole height of the support.

FIG. 2*d* shows a variant in which the yarn is guided outside the sidewall of the upper portion of the device by means of a conduit 34 in which the yarn enters at the base of the balloon and leaves along the surface of the lower portion. This embodiment facilitates the threading of the yarn and the provision of a ceramic conduit particularly resistant to the wear caused by the yarn.

Figure 3:
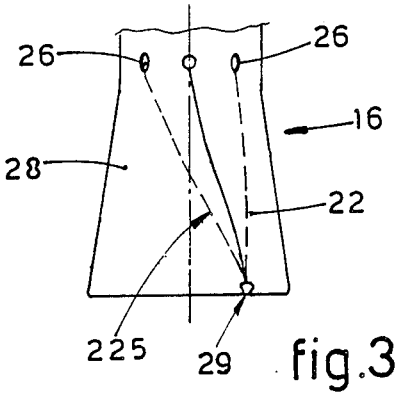

FIG. 3 shows a variant in which the distributor portion 28 of the checking device comprises a lead-in 29 as in FIG. 1, but a plurality of outlet holes 26 have been provided to vary the length of the portion 225 of yarn between the outlet hole 26 momentarily employed and the lead-in 29.

Figure 4:
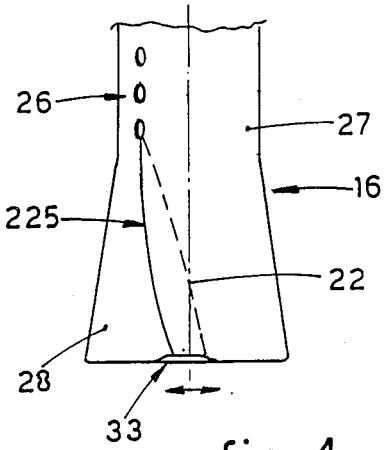

FIG. 4 shows a variant of the checking device that provides an elongated lead-in 33 in which the yarn 22 has a partial freedom of movement, as shown by arrows. Such partial freedom of movement may cushion any instantaneous variations in tension, and this cushioning effect may be added to the cushioning effect of the balloon or may well take up any variations in tension of a certain frequency, whereas the effect of the balloon may be greatest with regard to variations of a different frequency.

FIG. 4 shows diagrammatically a plurality of outlet holes 26 arranged along a generating line of the cylindrical portion 27 of the checking device. If the yarn 22 is caused to emerge from one or another of such holes, the length of the portion 225 of yarn between that outlet hole and the lower edge of the distributor portion 28 of the checking device will be varied.

The arc of winding of the portion 225 of yarn can also be pre-set to consist of one or more coils about the distributor portion 28 of the device by pre-arranging the yarn in the outlet hole 26 or lead-in 29 or inlet hole 32 suitable for the purpose.

The conformations of the holes or lead-ins 29, 31, 32, 33 shown in the figures are given merely as examples since the conformation will be selected in each case to optimize the running of the yarn.

Likewise, the upper and lower edges of the checking device will be conformed (for instance, rounded) so as to avoid damaging the yarn.

Figures 5, 6A:
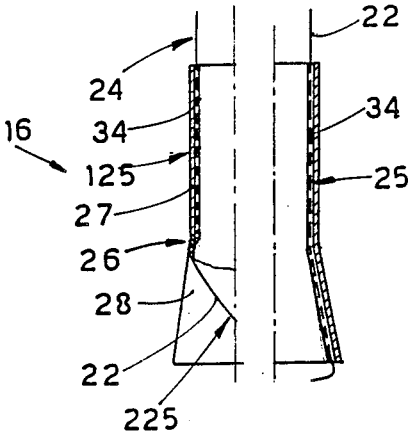

FIG. 5 shows another variant, in which the portion 125 of the yarn 22 is guided in a conduit 34 consisting here of a small pipe solidly fixed to the wall of the cylindrical portion 27 of the checking device. This small pipe 34 opens out into the outlet hole 26. This embodiment is especially useful for assisting the threading of the yarn.

In FIG. 5 too the portion 225 of yarn is not limited to a preferred position on the lower edge of the distributor portion 28 of the checking device but is free to move without any particular constraints apart from those imposed by equilibrium between the momentary traction applied to the yarn and the resistance to the motion of the balloon-checking device 16.

Figure 6B:
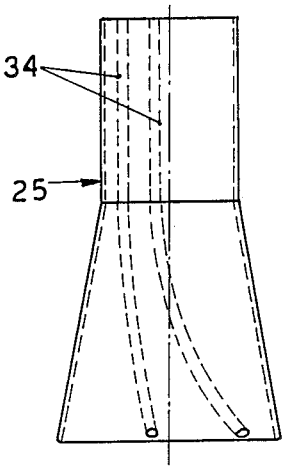

Instead, FIGS. 6a and 6b show an embodiment in which several small pipes 34 of different lengths extend along the whole length of the checking device 16. The lower end of each small pipe opens out at the edge of the distributor portion 28 of the checking device. The segment 25 of yarn is therefore guided completely within the small pipe 34. In this case the pre-determination of the winding arc is obtained by selecting the most suitable pipe 34.

It can be understood at once that all the intermediate situations between that of FIG. 5 and that of FIGS. 6*a* and 6*b* can be provided, that is to say, the small pipe 34 may end at any lengthwise position in the device, for instance at an outlet hole 26 located as required along a generating line of the distributor portion 28 of the device.

Moreover, instead of the conduit or small pipe 34 there may be a series of conduits or channels machined in the body of the checking device and having a development along a generating line or possibly a spiral development.

FIGS. 9*a* and 9*b* respectively show a section and a front view of a variant of the system to anchor the yarn to the surface of the distributor portion with a view to the predetermination of the winding arc. In this case the yarn leaving the outlet hole 26 is taken to a hole or guide 29, which is machined in a ring protruding from the outer surface and located at a certain distance from the edge of the device; the yarn is wound thereafter onto the yarn package.

In this embodiment the anchorage point 29 of the yarn is positioned at a certain distance from the edge of the device and therefore provides a given freedom of movement of the yarn on such edge with regard to the various winding steps.

Moreover, this embodiment enables optimum geometrics and surface treatments to be applied to the edge of the checking device.

It is to be understood that there may be a plurality of outlet holes 26 or anchorage holes 29 so as to obtain the desired ability to select the winding arc.

FIGS. 7*a* through 7*f* show the formation of a complete yarn pachage with a constant balloon. In this example the device 16 is stationary whereas the spindle 11 can move, as in FIG. 1, but it is clear that the same method can be applied to the case of FIG. 2*a* where the spindle rail 13 is stationary and the rail 19 of the device can move, or to any other case.

It should be noted that in all the steps of formation of the bobbin (7*a*–7*b*) and with all the winding diameters momentarily occurring the balloon keeps constant its basic geometric parameters D and H.

Figures 7A, 7B, 7C, 7D, 7E, 7F:
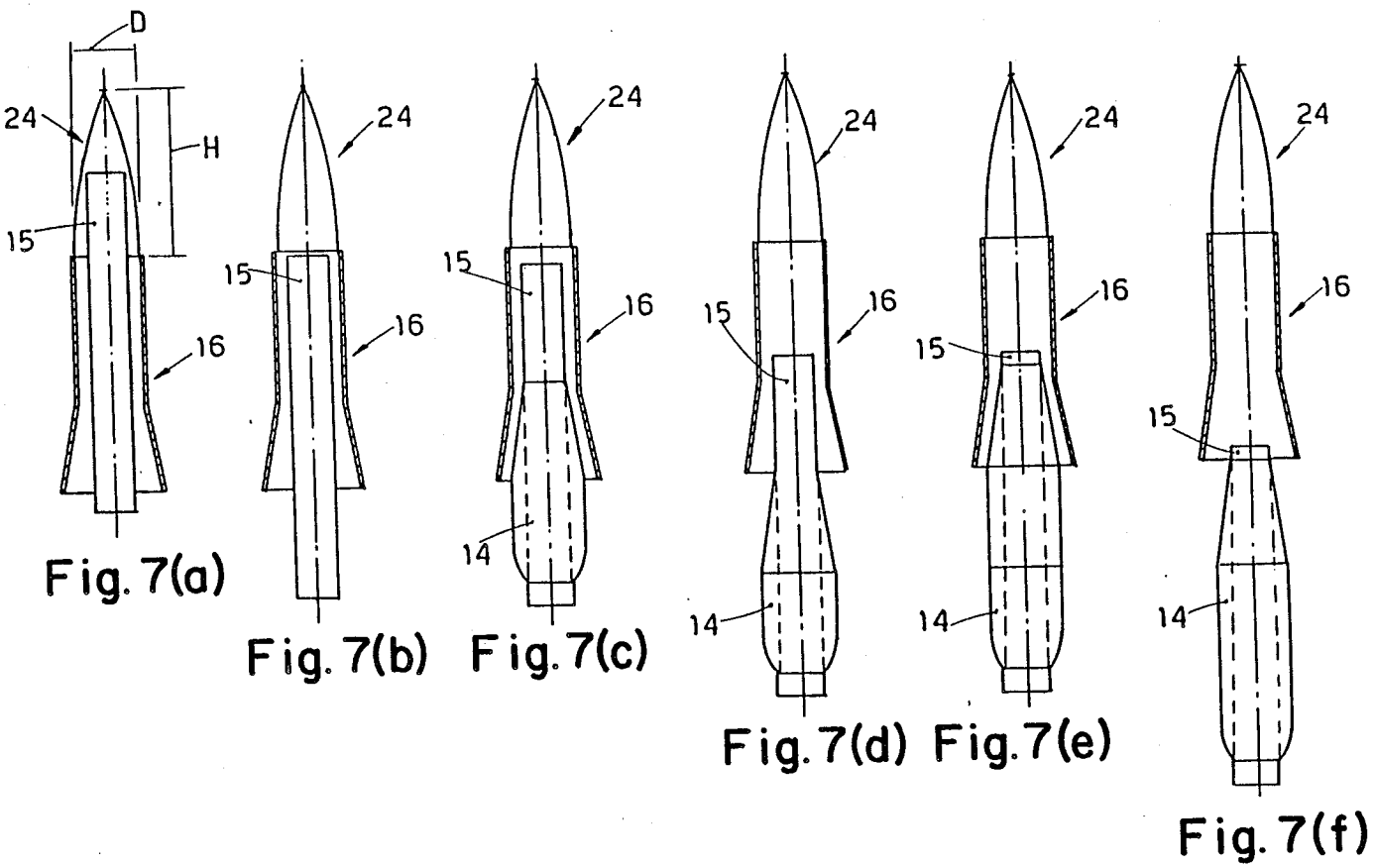

It should be noted from FIG. 7*a* that the lower limit of the value of the diameter D is the diameter of the tube 15.

Figure 8E:
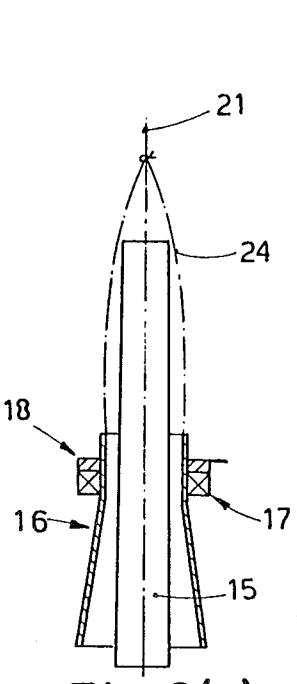
Figure 8D:
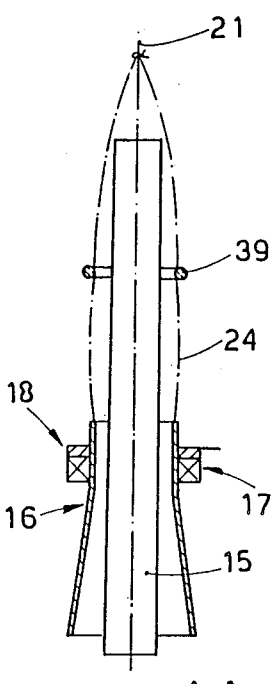
Figure 8C:
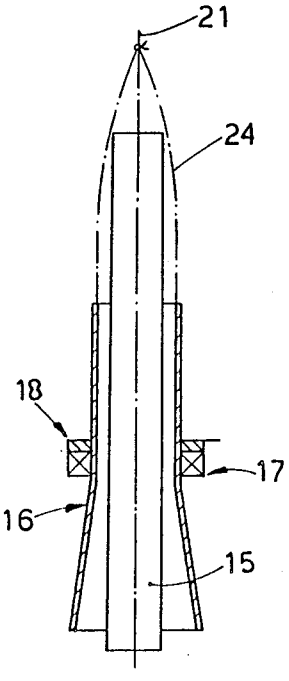
Figure 8B:
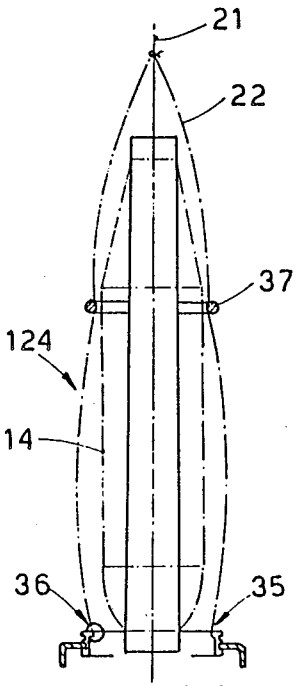
Figure 8A:
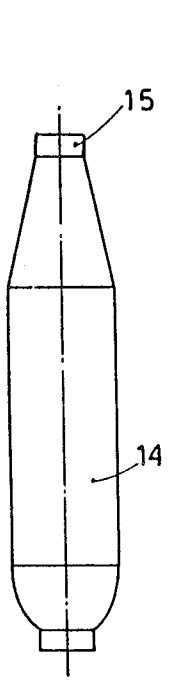

FIGS. 8*a*, 8*b* and 8*c* give a comparison of the balloon obtained with a stationary checking ring of the traditional type and the balloon obtained with the rotary checking device of this invention with regard to the yarn package to be wound.

FIG. 8*b* shows a spinning ring 35 with a small ring 36. A traditional checking means 37 consists in this case of a ring having a diameter the same as that of the spinning ring 35. Instead, FIG. 8*c* gives a diagram of the checking device 16 of FIG. 1. It is possible to see that, if the yarn package 14 has an equal diameter, the balloon remains in the upper zone alone and has reduced dimensions. This enables many advantages to be obtained which have already been cited in the introductory part of the description.

FIG. 8*d* shows a variant of the device 16 in which the rotary checking device cooperates with a traditional stationary checking device, whether it be a ring or another device, to control the balloon. Such an embodiment might be employed in the case of an especially high tube or where it is essential to overcome problems of overall bulk or light weight in particular applications of the invention.

FIG. 8*e* shows an embodiment kept to a minimum of height and especially suitable for tubes of a limited height, such as those employed for very fine yarns or yarns having special requirements regarding their ability to be unwound.

We have described here a set of preferred embodiments of the invention, but many variants are possible without departing thereby from the scope of the invention.

Thus the lengths and reciprocal proportions of the yarn segments 23 and 24 and yarn portions 125, 225 and 325 can be varied, and any required plurality of outlets 26 or inlets 31 or outlets 32 or lead-ins 29 or recessed portions 33 can be produced, which in turn can coexist in any desired arrangement in one and the same checking device 16.

The checking device 16 itself may have an overall tapered or possibly curved shape, for instance with a cigar-point shaped portion 28 or a variously radiused form.

These and yet other variants are possible without departing thereby from the scope and spirit of this invention.

We claim:

1. A method for spinning with a balloon which comprises a yarn controlled by a rotary checking device, wherein the yarn comprises a first free segment between a drafting unit and a thread eye, and a terminal free segment between the checking device and a yarn package, wherein the checking device is set in rotation by a spindle by means of the yarn, the method comrising the steps of:

a. arranging a segment of free yarn to form a balloon comprising a portion of the yarn and having a controlled and constant height and diameter of a base downstream of said first free segment of yarn, and b. arranging a guided segment of yarn downstream of the segment constituting the balloon which comprises a portion of the yarn and upstream of the terminal free segment of the yarn.

2. The method as claimed in claim 1, in which the height of the balloon is substantially the height between the thread eye and the point of entry of the yarn into the checking device.

3. The method as claimed in claim 1, in which the diameter of the base of the balloon is substantially the same as the diameter of contact between the balloon and the top of the checking device, and such diameter is less than or equal to the diameter of the yarn package.

4. The method as claimed in claim 3, further comprising the step of adjusting the height of the balloon.

5. The method as claimed in claim 4, in which the guided segment of yarn comprises at least one portion within the checking device.

6. The method as claimed in claim 5, in which the guided segment of yarn comprises at least one portion outside the checking device.

7. The method as claimed in claim 6, in which the guided segment of yarn has a length which can be preset.

8. The method as claimed in claim 7, in which the guided segment of yarn has a constant length.

9. The method as claimed in claim 7, in which the guided segment of yarn has a length which may vary in a controlled range.

10. The method as claimed in claim 6, in which the guided segment of yarn has a freely variable length.

11. A system for spinning a yarn package about a tube and controlling the dimensions of the balloon thereby generated with a single mechanism, comprising:

a rotary yarn-balloon-checking device positioned about the yarn package and the tube;

said checking device having a rotatably supported upper portion and a lower distributor portion for distributing the yarn on the yarn package, wherein said checking device is open and unobstructed at its upper end for allowing the formation of the balloon which comprises a portion of the yarn and has a pre-determined diameter to contact the yarn, the diameter of the upper end of the checking device being equal to or less than the diameter of the yarn package.

12. The system as claimed in claim 11, further comprising a thread eye for guiding the yarn, the distance between said thread eye and the top of said checking device being adjustable so as to control the height of the balloon.

13. The system as claimed in claim 12, in which said checking device has a length substantially smaller than that of the tube.

14. The system as claimed in claim 13, in which said checking device is freely rotatably supported by a support at the lower end of said upper supported portion adjacent said distributor portion.

15. The system as claimed in claim 14, in which said checking device comprises at least one inlet hole for the yarn in a diametral position.

16. The system as claimed in claim 15, in which said checking device comprises at least one outlet hole for the yarn at a desired position below said support.

17. The system as claimed in claim 16, in which said checking device comprises at least one lead-in on the lower edge of said distributor portion.

18. The system as claimed in claim 17, in which said checking device comprises at least one passage for winding the yarn in the vicinity of said lower edge of the distributor portion.

19. The system as claimed in claim 18, in which said checking device comprises at least one recessed portion on the lower edge of said distributor portion.

20. The system as claimed in claim 19, in which said checking device comprises a guide conduit along at least part of the lengthwise extent of said checking device

* * * * *